US011339463B1

(12) United States Patent
Smith et al.

(10) Patent No.: US 11,339,463 B1
(45) Date of Patent: May 24, 2022

(54) PHASE TRANSFORMATION STRENGTHENED NI-BASED DISK SUPERALLOY

(71) Applicant: United States of America as represented by the Administrator of NASA, Washington, DC (US)

(72) Inventors: Timothy M. Smith, Cleveland, OH (US); Robert W. Carter, Cleveland, OH (US)

(73) Assignee: United States of America as Represented by the Administrator of National Aeronautics and Space Administration, Washington, DC (US)

( * ) Notice: Subject to any disclaimer, the term of this patent is extended or adjusted under 35 U.S.C. 154(b) by 26 days.

(21) Appl. No.: 16/778,033

(22) Filed: Jan. 31, 2020

Related U.S. Application Data

(60) Provisional application No. 62/815,464, filed on Mar. 8, 2019.

(51) Int. Cl.

| | |
|---|---|
| ***C22F 1/10*** | (2006.01) |
| ***C22C 1/04*** | (2006.01) |
| ***C22C 19/05*** | (2006.01) |

(52) U.S. Cl.
CPC ..... *C22F 1/10* (2013.01); *C22C 1/0433* (2013.01); *C22C 19/056* (2013.01); *C22C 19/057* (2013.01)

(58) Field of Classification Search
CPC ..... C22C 19/057; C22F 1/10
See application file for complete search history.

(56) References Cited

U.S. PATENT DOCUMENTS 8,992,699 B2 * 3/2015 Bain ..... C22C 19/056 148/428
2013/0318982 A1 * 12/2013 Kim ..... F01D 5/081 60/772

OTHER PUBLICATIONS

T. M. Smith, et al., Phase transformation strengthening of high-temperature superalloys, Nat Commun 7, 13434 (2016) doi:10.1038/ncomms13434.
T. M. Smith, et al., Segregation and Phase Transformations Along Superlattice Intrinsic Stacking Faults in Ni-Based Superalloys, Metall and Mat Trans A (2018) 49:4186., https://doi.org/10.1007/s11661-018-4701-5.
T. M. Smith, et al., Effect of Stacking Fault Segregation and Local Phase Transformations on Creep Strength in Ni-base Superalloys, Acta Materialia, vol. 172, Jun. 15, 2019, pp. 55-65.

* cited by examiner

*Primary Examiner* — Jessee R Roe
(74) *Attorney, Agent, or Firm* — Robert H. Earp, III; Mark Wolfgang; Helen M. Galus

(57) ABSTRACT

A local phase transformation strengthened nickel-base superalloy includes at least 8.0 wt % eta phase formers; at least 7.0 wt % of chi phase formers; less than 12 wt % chromium; at least 18 wt % cobalt; and aluminum. A ratio of eta phase formers:aluminum is (3.2-3.4):1. The eta phase formers can include titanium, tantalum, hafnium, and niobium. The chi phase formers include tungsten and molybdenum. When the superalloy is subjected to elevated temperatures, these levels of components promote eta and chi phase formation along superlattice stacking faults, thereby resulting in a local phase transformation at the stacking faults, which strengthens the superalloy and inhibits creep deformation.

13 Claims, 3 Drawing Sheets

PHASE TRANSFORMATION STRENGTHENED NI-BASED DISK SUPERALLOY

CROSS REFERENCE TO RELATED APPLICATION

This application claims priority to U.S. Provisional Patent Application Ser. No. 62/815,464 filed Mar. 8, 2019, which is expressly incorporated herein by reference.

ORIGIN OF THE INVENTION

The invention described herein was made by employees of the United States Government and may be manufactured and used by or for the Government for Government purposes without the payment of any royalties thereon or therefor.

BACKGROUND

The efficiency and emissions of jet engines are related to the temperature at which the engine is operated. As the operating temperature is increased, the efficiency increases and the emissions are reduced. However, with increasing temperatures, materials used in these engines start to plastically deform under load in a process known as creep, which eventually sets the most severe limits on materials performance.

Polycrystalline nickel-base (Ni-base) superalloys are typically utilized for turbine disks in the hot section of jet engines because they offer a unique combination of creep resistance, fatigue resistance, and corrosion resistance. These superalloys provide good high temperature strength because they have an ordered face centered cubic (FCC) solid solution γ phase matrix, with a coherent γ' phase precipitate of $Ni_3Al$, which γ' phase precipitate can make up over 50% of the volume of the superalloy. The γ' phase adds strength to the superalloy by providing resistance against shearing from lattice dislocation movement, and thus offers remarkable strength at temperatures as high as 700° C.—a crucial capability for turbine disk components.

However, even these superalloys used in commercial turbine disks are limited to operating at temperatures only up to about 700° C. This is because at temperatures below 700° C., creep deformation in these Ni-base superalloys is a result of dislocation looping or shearing, against which the γ' phase precipitate offers resistance. However, above 700° C., creep deformation evolves into more diffusion mediated processes, such as the development of superlattice intrinsic stacking faults (SISFs) or superlattice extrinsic stacking faults (SESFs) in the γ' phase precipitate. The SISFs and SESFs, together are referred to herein as superlattice stacking faults (SSFs), are pathways of reduced resistance through which shearing more easily propagates.

These diffusion shearing modes develop at high temperatures (e.g. above 700° C.) and under stress, through the progression of atomic reordering and solute diffusion along faults in the γ' phase precipitate during deformation. In this process, γ formers from the γ phase matrix, such as cobalt (Co), chromium (Cr), and molybdenum (Mo), segregate along the SSFs in the γ' precipitate, in a process called γ segregation. This γ segregation along these γ' shearing SSFs may be accompanied by the formation of microtwins, which are greater than two-layer thick SSFs. It is believed the segregation of γ formers along the stacking faults occurs because it reduces the occurrence of aluminum to aluminum (Al—Al) nearest neighbor violations along the fault, thereby lowering the faults overall energy. This type of γ segregation along SSFs is detrimental to the overall creep properties because it provides an easier shearing path for dislocations to shear through the γ' phase precipitate, which γ' phase precipitate would otherwise normally provide strength to the superalloy. As such, the high temperature properties of these superalloys represent a limiting factor in increasing an engines operating temperature, and thus its efficiency and emissions.

SUMMARY

In one aspect, a nickel-base superalloy includes at least 8.0 wt % eta phase formers, at least 7.0 wt % of chi phase formers, less than 12 wt % chromium, at least 18 wt % cobalt, and aluminum. A ratio of eta phase formers:aluminum is (3.2-3.4):1.

In another aspect, a jet engine includes a component comprising a nickel-base superalloy. The superalloy includes at least 8.0 wt % eta phase formers, at least 7.0 wt % of chi phase formers, less than 12 wt % chromium, at least 18 wt % cobalt, and aluminum. A ratio of eta phase formers: aluminum is (3.2-3.4):1.

In another aspect, a method of producing a local phase transformation strengthened superalloy component is provided. The method includes providing a superalloy, and heating the superalloy above 700° C. to local phase transformation strengthen the superalloy. The superalloy includes at least 8.0 wt % eta phase formers, at least 7.0 wt % of chi phase formers, less than 12 wt % chromium, at least 18 wt % cobalt, and aluminum. A ratio of eta phase formers: aluminum is (3.2-3.4):1. The method may additionally include providing a mixture of alloy powers, and hot isostatic pressing the mixture to form the superalloy.

DETAILED DESCRIPTION

Figure 1:
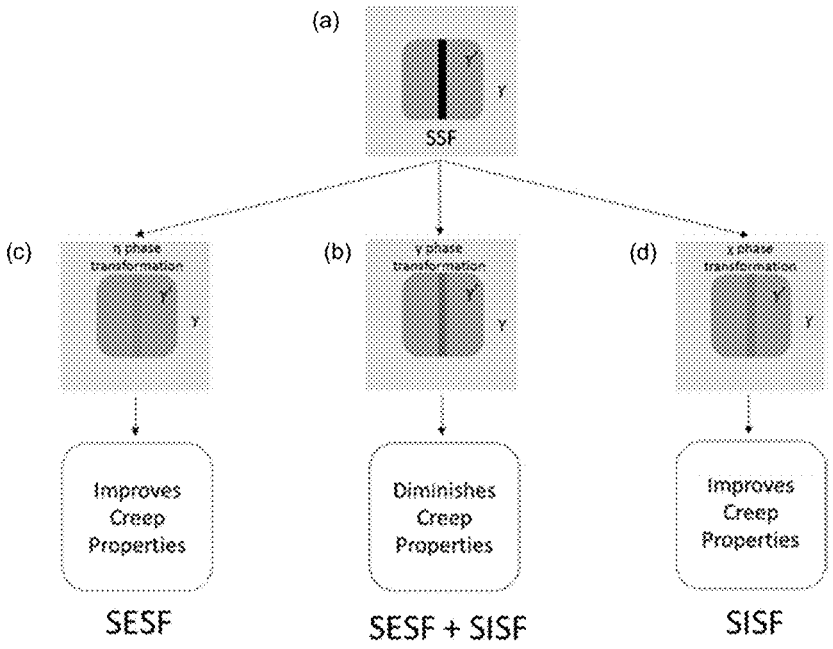
FIG. 1 is a schematic diagram of different segregation and phases associated with superlattice stacking faults, and their associated effect on a superalloys creep properties.

The present subject matter provides Ni-base superalloys that include specific alloying elements at specific increased amounts compared to conventional superalloys. At these increased amounts, the specific alloying elements inhibit deleterious γ segregation along SSFs at temperatures above 700° C., yet do not precipitate in the bulk of the superalloy even at these elevated amounts. As such, the formation of topologically close packed phases is avoided.

Through ultra-high-resolution structure and composition analysis via scanning transmission electron microscopy, combined with density functional theory calculations, it has been found that these inventive superalloys with relatively higher concentrations of these certain elements encourage a shear-induced solid-state transformation from the γ' phase to the eta (η) phase along SESFs in γ' phase precipitates, which stacking faults would normally be the precursors of deformation twins. This transformation to the nanoscale η phase is beneficial, because it creates a low-energy structure in the γ' phase precipitates that inhibits thickening of stacking faults into twins, leading to significant improvement in creep properties for the Ni-base superalloy. In particular, the high-temperature η phase strengthening mechanism has two important, beneficial aspects. First, the nucleation of a secondary ordered η phase at stacking faults operates to double the energy required to form additional partial dislocations required for nanotwinning and thus suppresses nanotwinning; and second, the formation of the η phase inhibits segregation of γ formers into the stacking fault, which would otherwise create a local γ-like phase at the fault that would promote nanotwinning.

The elements that promote the formation of the η phase are referred to herein as η phase formers or promoters, and these can include titanium (Ti), tantalum (Ta), hafnium (Hf), and niobium (Nb).

Specified amounts of η phase formers promote γ' to η phase transformation along the SESFs, which inhibits γ segregation at the SESFs. Thus, the formation of the η phase helps reduce γ segregation along SESFs. This change in segregation characteristics inhibits twin formation in the η phase forming superalloy, which provides improved creep strength at temperatures above 700° C.

It has also been found that a superalloy with relatively higher concentrations of certain other elements encourage a shear-induced solid-state transformation along SISFs in γ' precipitates, from the γ' phase to the chi (×) phase. This nanoscale χ phase is beneficial, because it creates a low-energy structure that inhibits the movement of stacking fault ribbons, leading to a significant improvement in creep properties for the Ni-base superalloy. This improved strength and reduction in creep is due to the suppression of ribbon formation, which ribbons weaken the superalloy and promote creep deformation and shearing. The χ phase resists shearing by inhibiting stacking fault ribbon movement through the γ' precipitates. The elements that promote the formation of the χ phase are referred to herein as χ phase formers or promoters, and these may include tungsten (W), molybdenum (Mo), and rhenium (Re). Although cobalt (Co) is a χ phase former, it will not be included when describing the χ phase formers. In this regard, the amount of Co in the superalloy will not be included in the amount disclosed for the χ phase formers, and the amount of the χ phase formers will not include the amount of Co.

Specified amounts of χ phase formers and Co, promote a transformation from γ' phase to a $Co_3W$ phase (i.e. χ phase) along the SISFs, which inhibits γ segregation at the SISFs and the formation of ribbons. Thus, the formation of the χ phase helps reduce γ segregation along SISFs and the formation of ribbons. Again, this change in segregation is associated with an improvement in creep strength above 700° C.

FIG. 1, gives an overview of these different segregation and phases associated with SISFs and SESFs, and their associated effect on a superalloys creep properties. As depicted in the (a) drawing at the top of FIG. 1, a superalloy includes γ' phases (one area of γ' phase precipitate is shown) precipitated throughout the γ phase matrix. Upon heating to a temperature of 760° C. and subject to a stress of 414-552 MPa, SSFs forms in the γ' phase (one SSF is shown in FIG. 1 as a black line extending vertically through the γ' phase).

As shown in the (b) drawing in middle column of FIG. 1, the SSF (darker grey line extending vertically through γ' phase) may embody a SESF and/or a SISF that have γ segregation providing a lower creep resistance for the superalloy compared to the inventive superalloys.

As shown in the (c) drawing in the left column of FIG. 1, if the superalloy includes η phase formers, then the SSF (darker grey line extending vertically through γ' phase) will embody a SESF including η phase, which increases creep resistance of the superalloy.

As shown in the (d) drawing in the right column of FIG. 1, if the superalloy includes χ phase formers, then the SSF (darker grey line extending vertically through γ' phase) will embody a SISF including χ phase, which increases creep resistance of the superalloy.

These two strengthening mechanisms are utilized together in a single superalloy to provide local chemical and structural changes along SSFs, which combine to represent atomic-scale phase transformations in the superalloy, and thereby provide a new creep strengthening mechanism for superalloys. This process of improving creep strength is accomplished by promoting η phase transformation along SESFs and χ phase transformation along SISFs, which collectively are referred to herein as local phase transformation (LPT) strengthening. In the present invention, η and χ LPT strengthening occurs by the inclusion of η phase formers and χ phase formers in a single superalloy.

Nickel-base superalloys are provided that experience this LPT strengthening at temperatures over 700° C. The inventive Ni-base superalloys include conventional alloying elements, along with relatively increased amounts of η phase formers and χ phase formers (not including Co), along with certain amounts of other alloying elements as described herein.

The superalloy may include η phase formers in an amount of at least 8.0 wt %, and up to 11.9 wt %. Then phase formers may include or consist of Ti, Ta, Nb, Hf, or combinations thereof. In a non-limiting example, a phase transformation strengthened Ni-based superalloy may include 2.75-3.5 wt % Ti, 4-6.4 wt % Ta, 1-1.5 wt % Nb, and 0.25-0.5 wt % Hf.

The superalloy may include χ phase formers (not including Co) in an amount of at least 7.0 wt %, and up to 19 wt %. The χ phase formers may include or consist of MO, W, Re, or a combination thereof. In a non-limiting example, a phase transformation strengthened Ni-based superalloy may include 2-6 wt % Mo, 2-10 wt % W, and 0-3 wt % Re. Rhenium may be included in single crystal Ni-based superalloys. In polycrystalline Ni-based superalloys, Re may be excluded.

The phase transformation strengthened Ni-based superalloy may also include less than 12 wt % Cr, at least 18 wt % cobalt Co, and aluminum (Al). A ratio of the η phase formers to Al in the superalloy may be (3.2-3.4):1. In other words, the η phase formers may be included at 3.2 to 3.4 times the weight of Al.

In a non-limiting example, a LPT strengthened Ni-based superalloy includes 18-20 wt. % Co, 8-12 wt % or 8-10 wt % Cr, 2.5-3.5 wt % Al, 2.75-3.5 wt % Ti, 4-6.4 wt % Ta, 1-1.5 wt % Nb, 0.25-0.5 wt % Hf, 2-6 wt % Mo, 2-10 wt % W, 0-3 wt % Re, 0.01-0.1 wt % zirconium (Zr), 0.01-0.1 wt % boron (B), 0.01-0.1 wt % carbon (C), 0-0.5 wt % or 0.01-0.5 wt % yttrium (Y), with a balance of nickel (Ni). The superalloy may include 0.05 wt % Zr, 0.03 wt % B, and 0.05 wt % C.

In each embodiment, the superalloy includes at least 8.0 wt % η phase formers, at least 7.0 wt % of χ phase formers, less than 12 wt % or less than 10 wt % Cr, at least 18 wt %

Co, and Al, wherein a ratio of η phase formers to Al was (3.2-3.4):1. The superalloy may be formed from a mixture of alloy powders having this level of components. It is believed that these levels of components promote η and χ phase formation along SESFs and SISFs respectively in the superalloy, thereby resulting in LPT strengthening of the superalloy.

The Co is included for solid solution strengthening of the γ phase and to nucleate the η phase and the χ phase along SESFs and SISFs, respectively. The Cr is included to provide improved corrosion and oxidation properties, and is included at lower amounts than compared to commercially available superalloys in order to mitigate the nucleation of γ phase along SSFs inside the γ' precipitate. The Al is included for the formation of γ' precipitates. The Ti, Ta, Nb, and Hf are included as formers and strengtheners by promoting η phase transformations along SESFs. The Mo, W, and Re are included as formers and strengtheners by promoting χ phase transformations along SISFs. The Zr, B, and C are included as grain boundary strengtheners. The Y is included to improve corrosion and oxidation resistance, which may be a concern because of the relatively lower Cr levels in the superalloy.

The superalloy may be produced by conventional methods such as casting, forging, or powder metallurgy including hot isostatic pressing of alloy powders. The superalloy may be processed into various form factors, including components for jet engines, including turbine disks or blades. The superalloys may also be used in other high stress, high temperature environments including those found in power plants and space launch systems, for example.

Examples

The following inventive examples were prepared to illustrate the invention, and should not be construed to limit the same. Three example superalloys were created to show both the χ and η LPT strengthening mechanisms being utilized in a single superalloy. Each example was formed by alloy powders including at least 8.0 wt % η phase formers, at least 7.0 wt % of χ phase formers, less than 12 wt % Cr, at least 18 wt % Co, and Al, wherein a ratio of η phase formers to Al was (3.2-3.4):1.

The example superalloys were formed by consolidating the alloy powders through a hot isostatic press (HIP), and then the example superalloys were heat treated at different temperature regimes to achieve a γ/γ' microstructure.

The example superalloys were labeled NASA Alloy 1, NASA Alloy 2, and NASA Alloy 3. All three alloys underwent three different solution heat treatments that resulted in different grain sizes as shown in FIG. 2.

Figure 2:
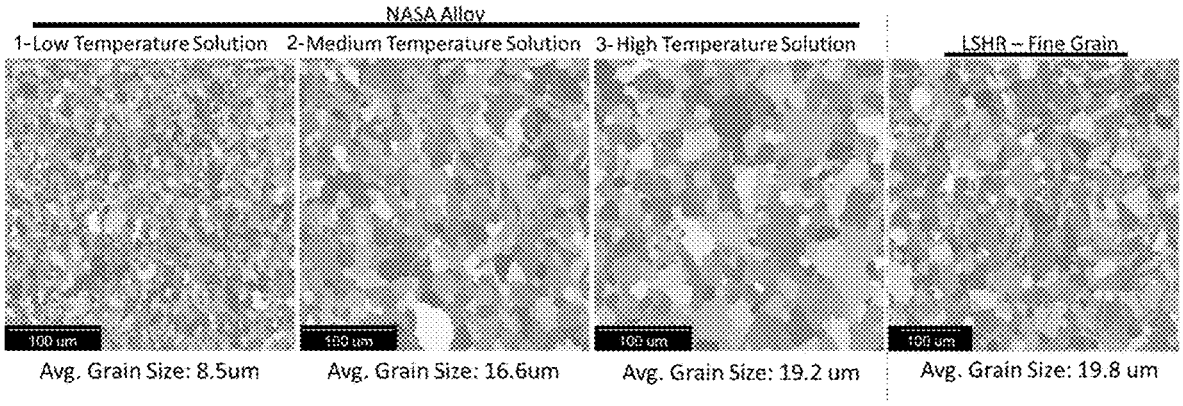
FIG. 2 are electron backscatter diffraction grain orientation maps of three superalloys according to the present subject matter, compared to a conventional superalloy.

As shown in FIG. 2, the NASA Alloys that were prepared in a low temperature solid solution heat treatment had an average grain size of 8.5 μm; the NASA Alloys that were prepared in a medium temperature solution heat treatment had an average grain size of 16.6 μm; and the NASA Alloys that were prepared in a high temperature solution heat treatment had an average grain size of 19.2 μm. Since the example superalloys were acquired in the as-HIP state (i.e. in a state as produced by hot isostatic pressing), the largest average grain size that could be achieved through heat treatment was around 19 μm. As this size corresponds to the fine grained LSHR specimen, all the NASA alloys are considered fine grained (FG).

Figure 3:
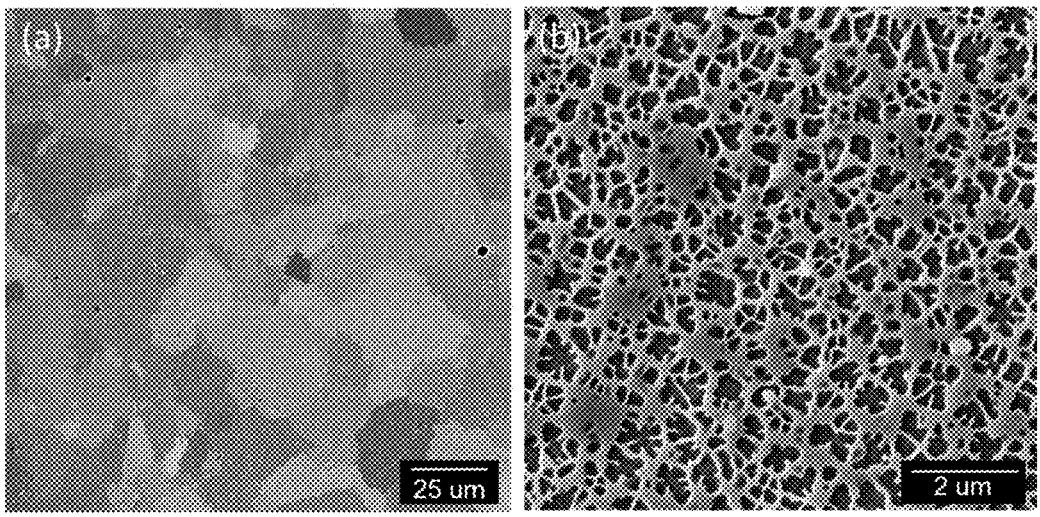
FIG. 3 are SEM micrographs of a superalloy according to the present subject matter.

After consolidation and the high temperature solution heat treatment, the example superalloys did not have detrimental TCP phases in the bulk of the superalloy from precipitation of the alloying elements. This lack of TCP phases is shown in the SEM micrographs of the NASA Alloy 1 in FIG. 3, which reveals a lack of TCP phase formation in SEM (a), and depicts the γ/γ' precipitate microstructure in SEM (b).

In order to compare the creep properties of the example superalloys due to η and χ LPT strengthening, comparative examples using ME3 and LSHR superalloys were also prepared and mechanically tested. However, the ME3 and LSHR disk superalloys were forged, rather than hot isostatic pressed, and thus each had an average grain size of 60 um, which was considered a coarse grain (CG) size. For a better comparison with the smaller grain size of the examples, fine grain LSHR with an average grain size near 20 um was also prepared and tested. FIG. 2 shows electron backscatter diffraction (EBSD) grain orientation maps of the grain structure in the example superalloys after a solution heat treatment at (1) low, (2) medium, and (3) high temperatures. A comparison EBSD grain orientation map of fine grain (FG) LSHR is also shown in comparison to the example superalloys.

Interestingly, the example superalloys display a significantly reduced number of annealing twins compared to LSHR. For the mechanical tests of the example superalloys, the high temperature solution microstructure was used.

The fine grain LSHR and example superalloys were first tensile tested at room temperature to highlight any significant differences in strength between the four superalloys. Table 1 below reveals the measured ultimate tensile strength, yield strength, elongation, and reduction in area (RA) for each superalloy.

TABLE 1

Tensile data for the example superalloys and fine grain LSHR.

| Specimen ID | Temp. (° C.) | Modulus (GPa) | U.T.S. (MPa) | 0.2% Y.S. (MPa) | Elong. (%) | RA (%) |
|---|---|---|---|---|---|---|
| NASA Alloy 1 | RT | 214.4 | 1696 | 1151 | 16 | 15 |
| NASA Alloy 2 | RT | 215.8 | 1675 | 1117 | 14 | 13 |
| NASA Alloy 3 | RT | 213.0 | 1710 | 1110 | 17 | 18 |
| LSHR - FG | RT | 215.8 | 1627 | 1124 | 20 | 35 |

Overall, the tensile strengths of the four superalloys did not vary significantly. However, the LSHR-FG comparative example presented better elongation and RA values compared to the example superalloys. The similar room temperature strengths of the four superalloys suggests that their microstructure (grain size, precipitate size, and volume fraction, etc.) do not vary in a significant way from each other. The heat treated example superalloys were then tested in tension creep under 552 MPa at 760° C.—a temperature and stress regime where creep deformation mechanisms, i.e. SISFs and SESFs, are active. The four superalloys were allowed to cool under load after 0.3% creep strain was reached.

The creep strain versus time was measured for the inventive example NASA Alloy 1, which was in the as-HIP state, along with comparative example of ME3-CG and LSHR-CG. The measure creep strain over time is depicted in FIG. 4.

Figure 4:
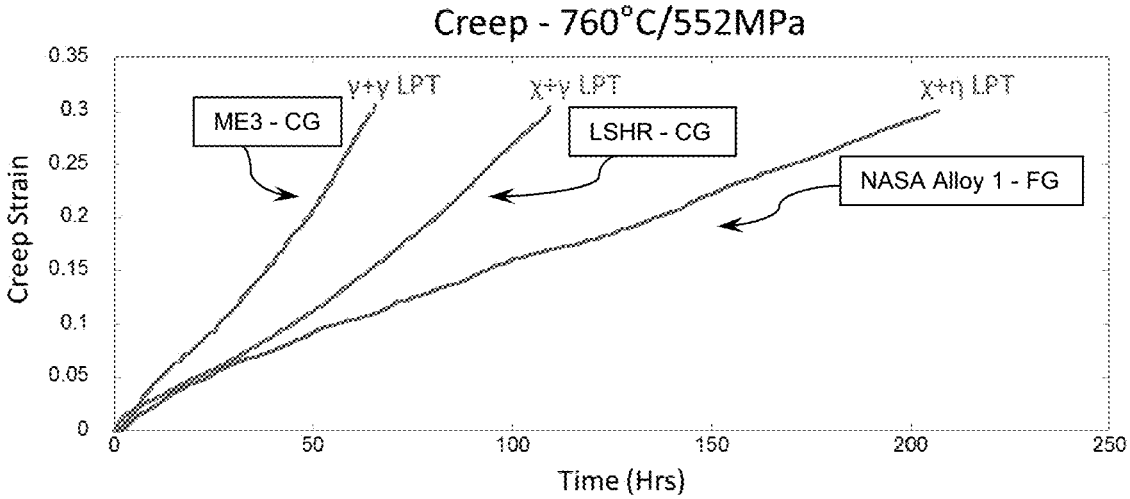
FIG. 4 is a plot of creep strain over time for a superalloy according to the present subject matter, compared to two conventional superalloys.

As shown in FIG. 4, the inventive example NASA Alloy 1 exhibits a slower creep strain rate compared to the comparative examples, which are state-of-the-art disk superalloys ME3-CG and LSHR-CG. As depicted in FIG. 4, the NASA Alloy 1 reached 0.3% creep strain after about 200 hours, which is significantly longer than about 65 hours for ME3-CG, and about 110 hours for LSHR-CG. The improved creep strain rate for NASA Alloy 1 is even more impressive when considering that larger average grain size usually produces a slower creep strain rate. However, the NASA Alloy 1 possesses a smaller average grain size than the comparative examples, with an average grain size that is ⅓ that of the comparative example superalloys.

Figure 5:
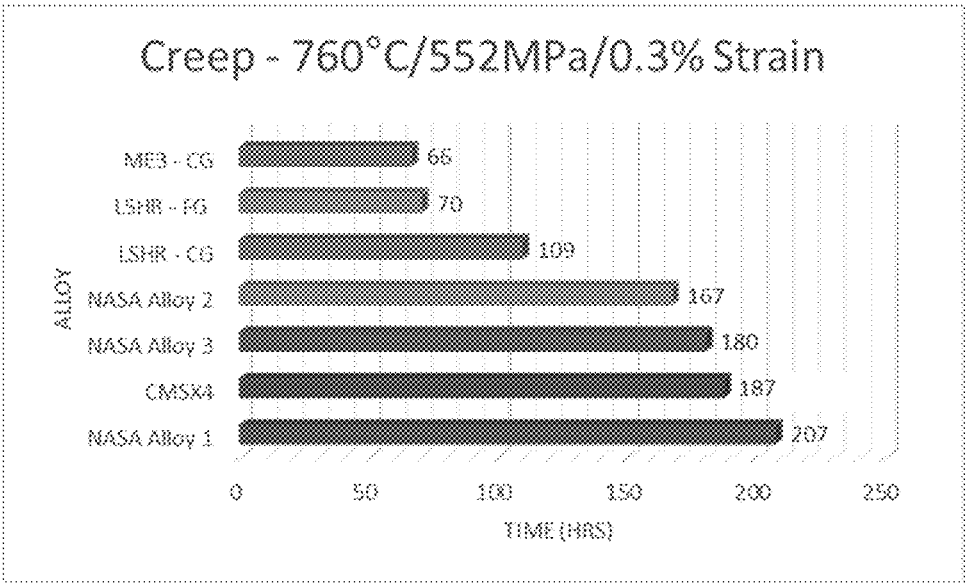
FIG. 5 is a bar graph showing the time it took to reach 0.3% strain for three superalloys according to the present subject matter, compared to four conventional superalloys.

The creep strain of each example superalloy and comparative superalloy was tested at 760° under 552 Mpa. FIG. 5 reveals the time it took for every superalloy to reach 0.3% creep strain.

One notable observation from FIG. 5 is the decrease in creep properties of the LSHR-FG compared to the LSHR-CG, which highlights that the larger grain size normally improves the creep strain rate for a Ni-base superalloy at this temperature. Also included in the FIG. 5 is an estimated creep time for CMSX-4 superalloy in the same stress and temperature regime. The estimated creep time of 187 hours for CMSX-4 was arrived at by extrapolation of the primary creep rate (4.44e-9 1/s) provided in a study by C. M. F. Rae, R. C. Reed, Primary Creep in Single crystal Superalloys: Origins, Mechanisms and Effects, Acta Mater., 55 (2007) 1067-1081. doi:10.1016/j.actamat.2006.09.026

As seen in FIG. 5, NASA Alloy 1 exhibited a lesser creep strain rate, and thus took longer to reach 0.3% creep strain, than the measured creep rate for CMSX-4 provided by Rae and Reed. These creep results show that the LPT strengthening mechanisms are active in the three inventive example superalloys, which at least 8.0 wt % η phase formers, at least 7.0 wt % of χ phase formers, less than 12 wt % Cr, at least 18 wt % Co, and Al, wherein a ratio of η phase formers to Al was (3.2-3.4):1. In addition, the effect these LPT strengthening mechanisms have on creep appears to be substantial compared to known superalloys—even overcoming the well-known effect of grain size on creep at this temperature.

These disk superalloys have been provided to leverage the LPT strengthening mechanisms for improved creep properties. As shown, these superalloys provide a significant improvement in creep strength compared to the current state-of-the-art disk superalloys ME3 and LSHR, which improvement is believed to be due to the presence of η and χ phase formation along SESFs and SISFs respectively.

It will be appreciated that various of the above-disclosed and other features and functions, or alternatives or varieties thereof, may be desirably combined into many other different systems or applications. Also, that various presently unforeseen or unanticipated alternatives, modifications, variations or improvements therein may be subsequently made by those skilled in the art which are also intended to be encompassed by the following claims.

The invention claimed is:

1. A nickel-base superalloy comprising:
at least 8.0 weight percent (wt %) eta (η) phase formers;
at least 7.0 wt % of chi (χ) phase formers;
less than 10 wt % chromium (Cr);
at least 18 wt % cobalt (Co);
0.01-0.5 wt % yttrium (Y); and
aluminum (Al), wherein a ratio of η phase formers:Al is (3.2-3.4):1.

2. The superalloy according to claim 1, including 8-11.9 wt % of the η phase formers.

3. The superalloy according to claim 2, wherein the η phase formers consist of titanium (Ti), tantalum (Ta), niobium (Nb), hafnium (Hf), or combinations thereof.

4. The superalloy according to claim 3, comprising:
2.75-3.5 wt % Ti;
4-6.4 wt % Ta;
1-1.5 wt % Nb; and
0.25-0.5 wt % Hf.

5. The superalloy according to claim 1, including 7-19 wt % of the χ phase formers.

6. The superalloy according to claim 5, wherein the χ phase formers consist of molybdenum (Mo), tungsten (W), rhenium (Re), or combinations thereof.

7. The superalloy according to claim 6, comprising:
2-6 wt % Mo;
2-10 wt % W; and
0-3 wt % Re.

8. The superalloy according to claim 1, including:
18-20 wt. % Co;
8-less than 10 wt % Cr;
2.5-3.5 wt % Al;
2.75-3.5 wt % titanium (Ti);
4-6.4 wt % tantalum (Ta);
1-1.5 wt % niobium (Nb);
0.25-0.5 wt % hafnium (Hf);
2-6 wt % molybdenum (Mo);
2-10 wt % tungsten (W);
0-3 wt % rhenium (Re);
0.01-0.1 wt % zirconium (Zr);
0.01-0.1 wt % boron (B);
0.01-0.1 wt % carbon (C);
and
a balance of nickel (Ni).

9. A jet engine including a component comprising a nickel-base superalloy, the superalloy including:
at least 8.0 weight percent (wt %) eta (η) phase formers;
at least 7.0 wt % of chi (χ) phase formers;
less than 10 wt % chromium (Cr);
at least 18 wt % cobalt (Co);
0.01-0.5 wt % yttrium (Y); and
aluminum (Al), wherein a ratio of η phase formers:Al is (3.2-3.4):1.

10. The jet engine according to claim 9, wherein the component is formed by hot isostatic pressing of the superalloy.

11. The jet engine according to claim 9, wherein the superalloy is local phase transformation strengthened.

12. The engine according to claim 11, wherein:
the superalloy further includes γ' precipitates dispersed in a γ phase matrix;
the χ phase forms along superlattice intrinsic stacking faults in the γ' precipitates; and
the η phase forms along superlattice extrinsic stacking faults in the γ' precipitates.

13. The engine according to claim 11, wherein the superalloy includes:
2.75-3.5 wt % Ti;
4-6.4 wt % Ta;
1-1.5 wt % Nb;
0.25-0.5 wt % Hf;
2-6 wt % Mo;
2-10 wt % W; and
0-3 wt % Re.

* * * * *